US010468824B2

(12) United States Patent
Lin et al.

(10) Patent No.: US 10,468,824 B2
(45) Date of Patent: Nov. 5, 2019

(54) CONNECTOR STRUCTURE AND MANUFACTURING METHOD THEREOF

(71) Applicant: P-TWO INDUSTRIES INC., Taoyuan (TW)

(72) Inventors: Hsien-Chang Lin, Taoyuan (TW); Kuei-Tien Fu, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 15/978,174

(22) Filed: May 13, 2018

(65) Prior Publication Data

US 2019/0044287 A1 Feb. 7, 2019

(30) Foreign Application Priority Data

Aug. 3, 2017 (TW) ..... 106126496 A

(51) Int. Cl.

| | |
|---|---|
| ***H01R 13/648*** | (2006.01) |
| ***H01R 13/6585*** | (2011.01) |
| ***H01R 13/502*** | (2006.01) |
| ***H01R 13/6593*** | (2011.01) |
| ***H01R 13/504*** | (2006.01) |
| *H01R 12/72* | (2011.01) |
| *H01R 24/62* | (2011.01) |

(52) U.S. Cl.

CPC ..... *H01R 13/6585* (2013.01); *H01R 13/502* (2013.01); *H01R 13/504* (2013.01); *H01R 13/6593* (2013.01); *H01R 12/724* (2013.01); *H01R 24/62* (2013.01)

(58) Field of Classification Search

CPC ..... H01R 13/6587
USPC ..... 439/607.07, 607.09, 660
See application file for complete search history.

(56) References Cited

U.S. PATENT DOCUMENTS

| | | | | |
|---|---|---|---|---|
| 9,705,267 | B2 * | 7/2017 | Cheng | H01R 24/60 |
| 9,853,387 | B2 * | 12/2017 | Dai | H01R 13/405 |
| 9,991,640 | B2 * | 6/2018 | Tziviskos | H01R 13/6581 |
| 10,170,867 | B2 * | 1/2019 | Ju | H01R 13/6585 |
| 2012/0252281 | A1 * | 10/2012 | Hsia | H01R 13/6581 439/660 |
| 2015/0295362 | A1 * | 10/2015 | Tziviskos | H01R 13/6581 439/607.01 |

* cited by examiner

*Primary Examiner* — Phuong K Dinh
(74) *Attorney, Agent, or Firm* — Winston Hsu

(57) ABSTRACT

A connector structure includes an insulating main body, a shielding plate, a plurality of first terminals, a plurality of second terminals, a protecting component and a housing. The insulating main body includes a base portion and a tongue portion extending out of the base portion, and the tongue portion includes a first surface, a second surface opposite to the first surface, and two lateral surfaces disposed between the first surface and the second surface. The shielding plate is disposed inside the tongue portion and between the first surface and the second surface. The first terminals are disposed on the first surface. The second terminals are disposed on the second surface. The protecting component is disposed on the two lateral surfaces of the tongue portion. The housing surrounds the tongue portion to define a docking space, and an opening is formed on a side of the docking space.

29 Claims, 9 Drawing Sheets

CONNECTOR STRUCTURE AND MANUFACTURING METHOD THEREOF

BACKGROUND OF THE INVENTION

Field of the Invention

The present invention relates to a connector structure and a manufacturing method thereof, and more particularly, to a connector structure capable of protecting a tongue structure and a manufacturing method thereof.

Description of the Prior Art

With rapid development of electronic industries and multimedia application, data transmission between electrical appliances is increasing gradually. Besides expanding transmission bandwidth, the current trend is towards to utilize electrical connectors with high frequency signal transmission. The need for standardization in computer related interfaces, as well as the need for high-speed communication interfaces, leads to the development of the universal serial bus (USB) interface. More recently, the USB Type-C connector has emerged as a USB-type connector having a relatively compact size, ultrahigh data transmission speed, and being configured so that the USB Type-C connector can be coupled without regard to plug orientation and/or cable direction, for extensive applications on different electronic devices.

A conventional USB Type-C connector usually includes an insulating main body, a plurality of first terminals, a plurality of second terminals and a hollow housing. The insulating main body includes a base and a tongue extending from a side of the base. The plurality of first terminals and the plurality of second terminals are disposed on the base and the tongue. A front end of each first terminal is disposed on an upper surface of the tongue, and a rear end of each first terminal protrudes out of the base to connect with a circuit board. A front end of each second terminal is disposed on a lower surface of the tongue, and a rear end of each second terminal protrudes out of the base to connect with the circuit board. The hollow housing covers the insulating main body and surrounds the tongue to form an opening.

However, the tongue of the conventional USB Type-C connector might be worn or deformed as being connected with a docking connector, resulting in unstable structure and affecting high frequency signal transmission. Therefore, there is a need to develop an improved connector structure capable of preventing the tongue from being worn or deformed, especially for connectors with high-speed communication.

SUMMARY OF THE INVENTION

Therefore, an objective of the present invention is to provide a connector structure capable of protecting a tongue structure and a manufacturing method thereof, for solving the aforementioned problems that a tongue of a conventional USB Type-C connector might be worn or deformed as being connected with a docking connector, resulting in unstable structure and affecting high frequency signal transmission.

In order to achieve the aforementioned objective, the present invention discloses a connector structure including an insulating main body, a shielding plate, a plurality of first terminals, a plurality of second terminals, a protecting component and a housing. The insulating main body includes a base portion and a tongue portion extending out of the base portion, and the tongue portion includes a first surface, a second surface opposite to the first surface, and two lateral surfaces disposed between the first surface and the second surface. The shielding plate is disposed inside the tongue portion and between the first surface and the second surface. The plurality of first terminals are disposed on the first surface. The plurality of second terminals are disposed on the second surface. The protecting component is disposed on the two lateral surfaces of the tongue portion. The housing surrounds the tongue portion to define a docking space, and an opening is formed on a side of the docking space.

In order to achieve the aforementioned objective, the present invention further discloses a method of manufacturing a connector structure. The method includes providing a connecting terminal structure, the connecting terminal structure comprising a first main portion, a second main portion opposite to the first main portion, and a shielding plate disposed between the first main portion and the second main portion, a plurality of the first terminals being disposed on the first main portion, a plurality of the second terminals being disposed on the second main portion, the shielding plate comprising two interfering portions at two lateral sides on an rear end of the shielding plate. The method further includes assembling a pair of protecting portions with the connecting terminal structure, the pair of protecting portions inserting into the first main portion and the second main portion along two sides of the shielding plate from front to back, each protecting portion comprising an engaging portion on an rear end of the protecting portion for engaging with the corresponding interfering portion. The method further includes installing a third main portion on the connecting terminal structure by inserting molding, the third main portion covering the engaging portion, the two interfering portions, the first main portion and the second main portion.

The connector structure of the present invention utilizes the protecting portions disposed on the two lateral sides of the tongue portion for protecting the lateral sides of the tongue portion so as to reinforce structure of the tongue portion. The structural design of the present invention can solve a conventional problem that a tongue of a conventional connector might be worn or deformed as being connected with a docking connector, resulting in unstable structure and affecting high frequency signal transmission.

These and other objectives of the present invention will no doubt become obvious to those of ordinary skill in the art after reading the following detailed description of the preferred embodiment that is illustrated in the various figures and drawings.

DETAILED DESCRIPTION

In order to illustrate technical specifications and structural features as well as achieved purposes and effects of the present invention, relevant embodiments and figures are described as follows.

Figure 1:
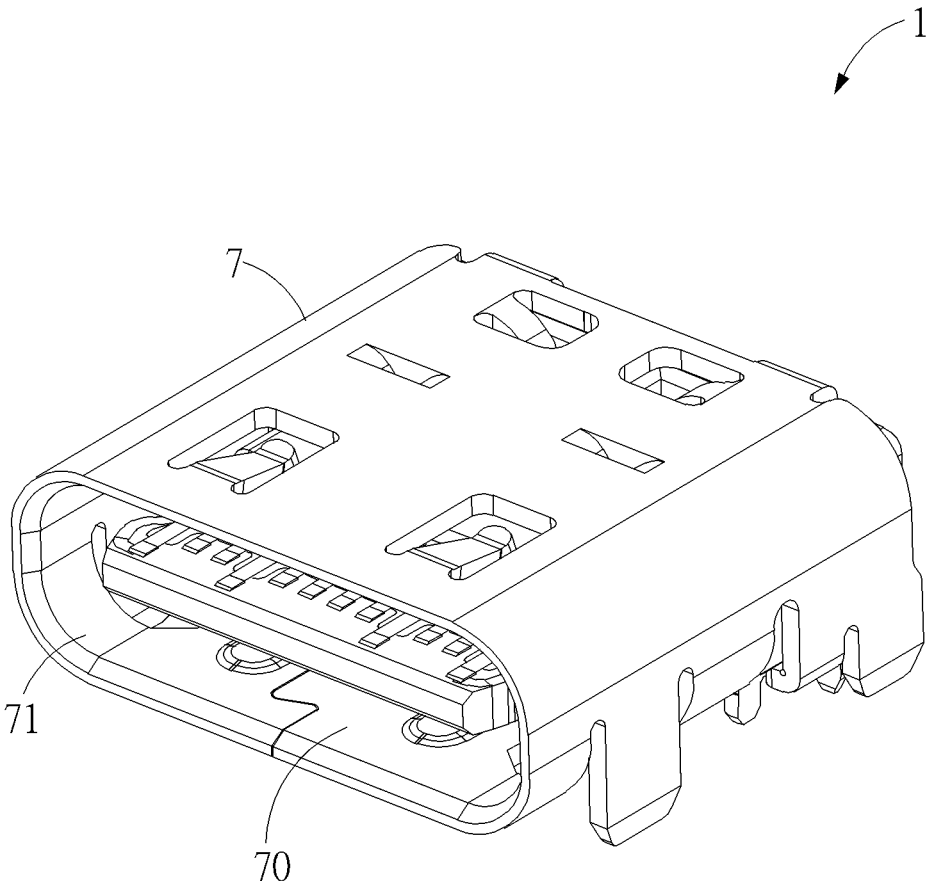
FIG. 1 is a schematic diagram of a connector structure according to an embodiment of the present invention.
Figure 2:
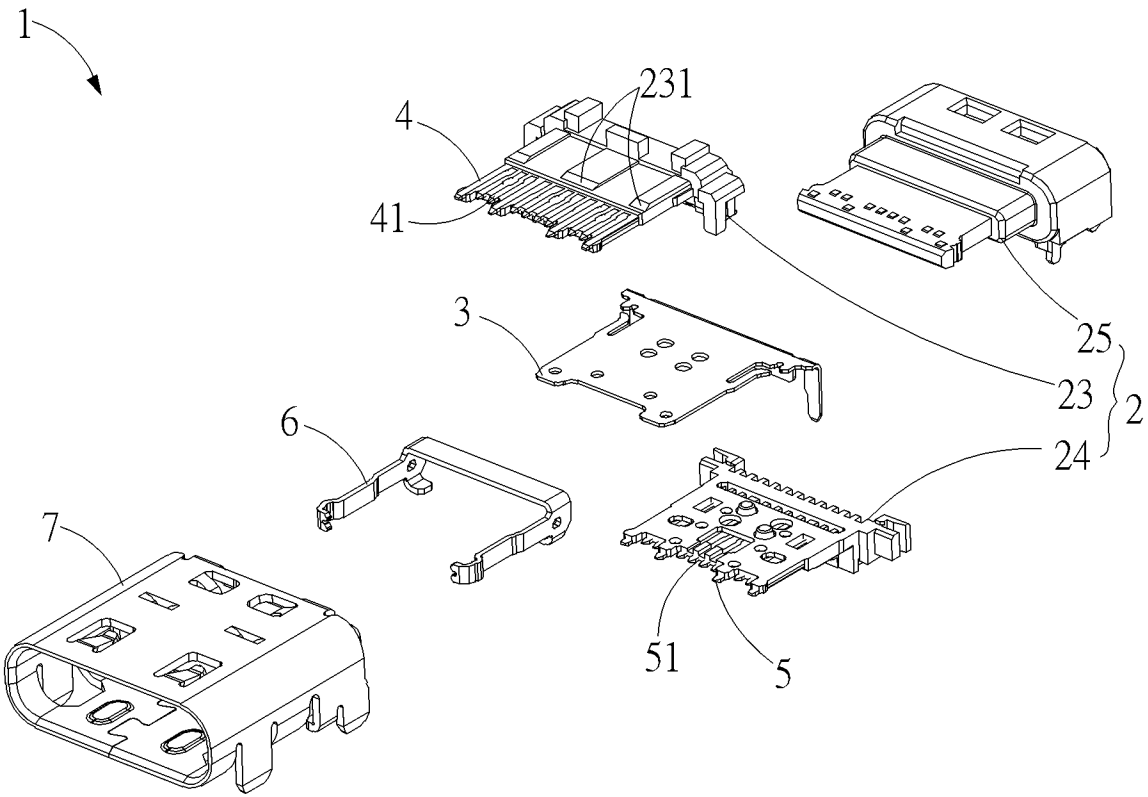
FIG. 2 is an exploded diagram of the connector structure as shown in FIG. 1 according to the embodiment of the present invention.
Figure 3:
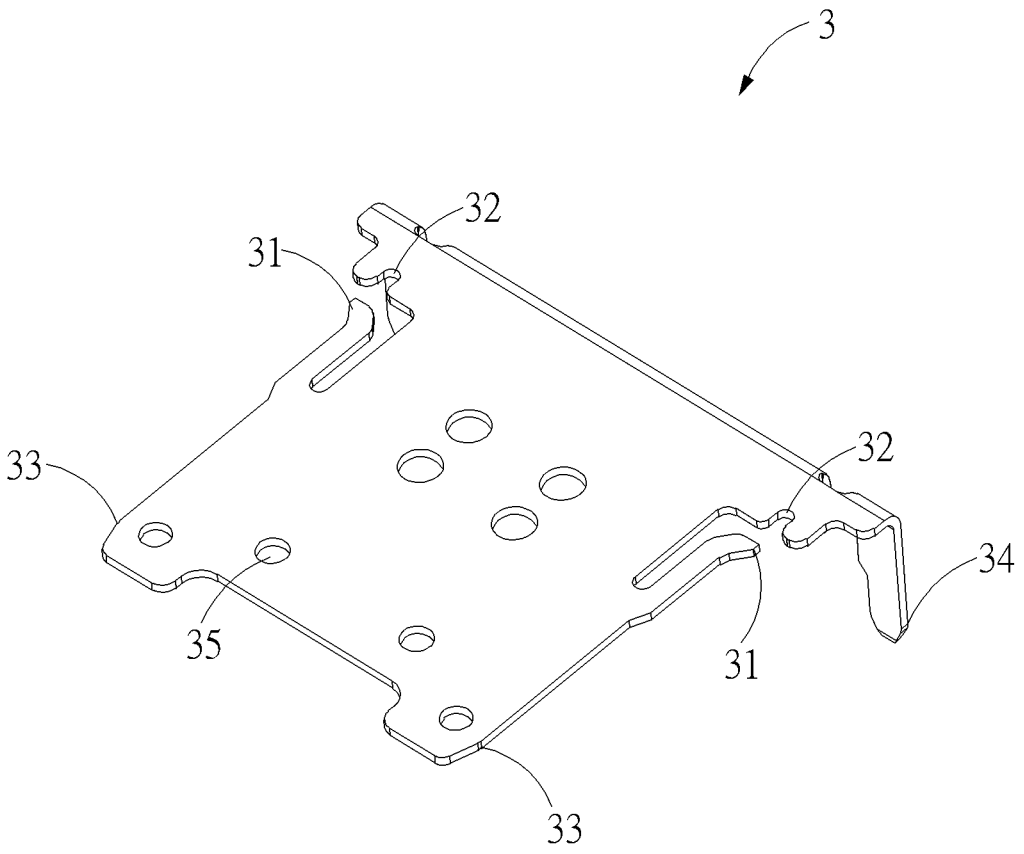
FIG. 3 is a schematic diagram of a shielding plate of the connector structure as shown in FIG. 2 according to the embodiment of the present invention.
Figure 4:
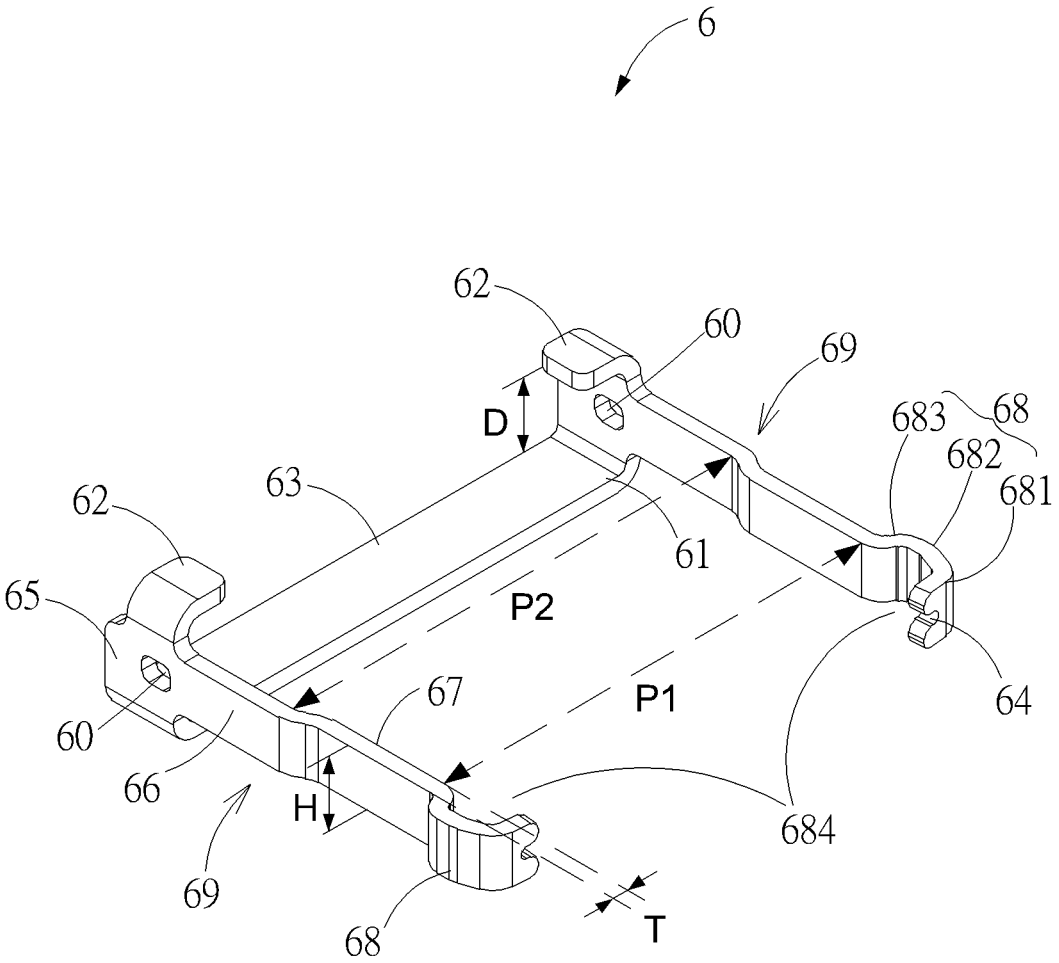
FIG. 4 is a schematic diagram of a protecting component of the connector structure as shown in FIG. 2 according to the embodiment of the present invention.
Figure 5:
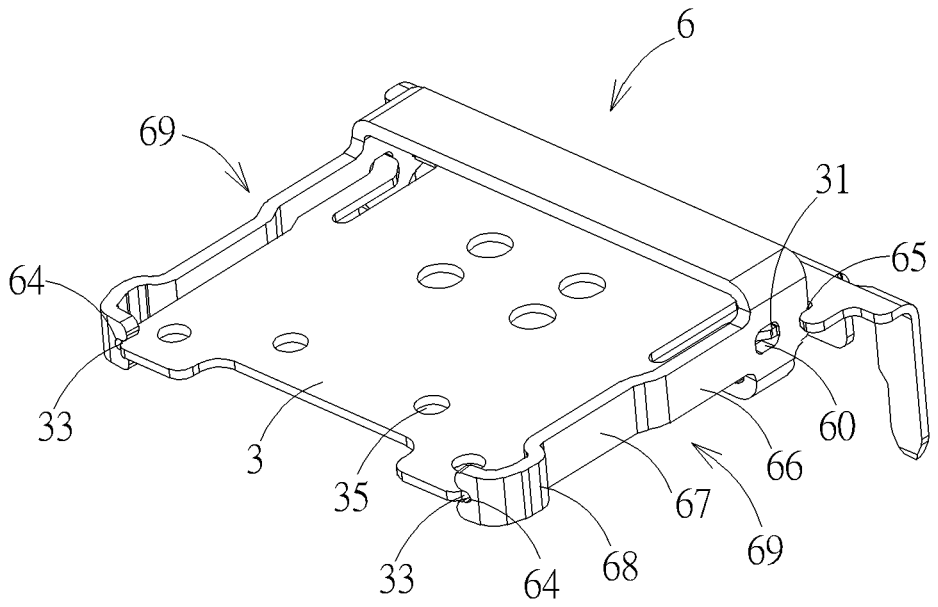
FIG. 5 is a schematic diagram of the protecting component assembled with the shielding plate according to the embodiment of the present invention.
Figure 6:
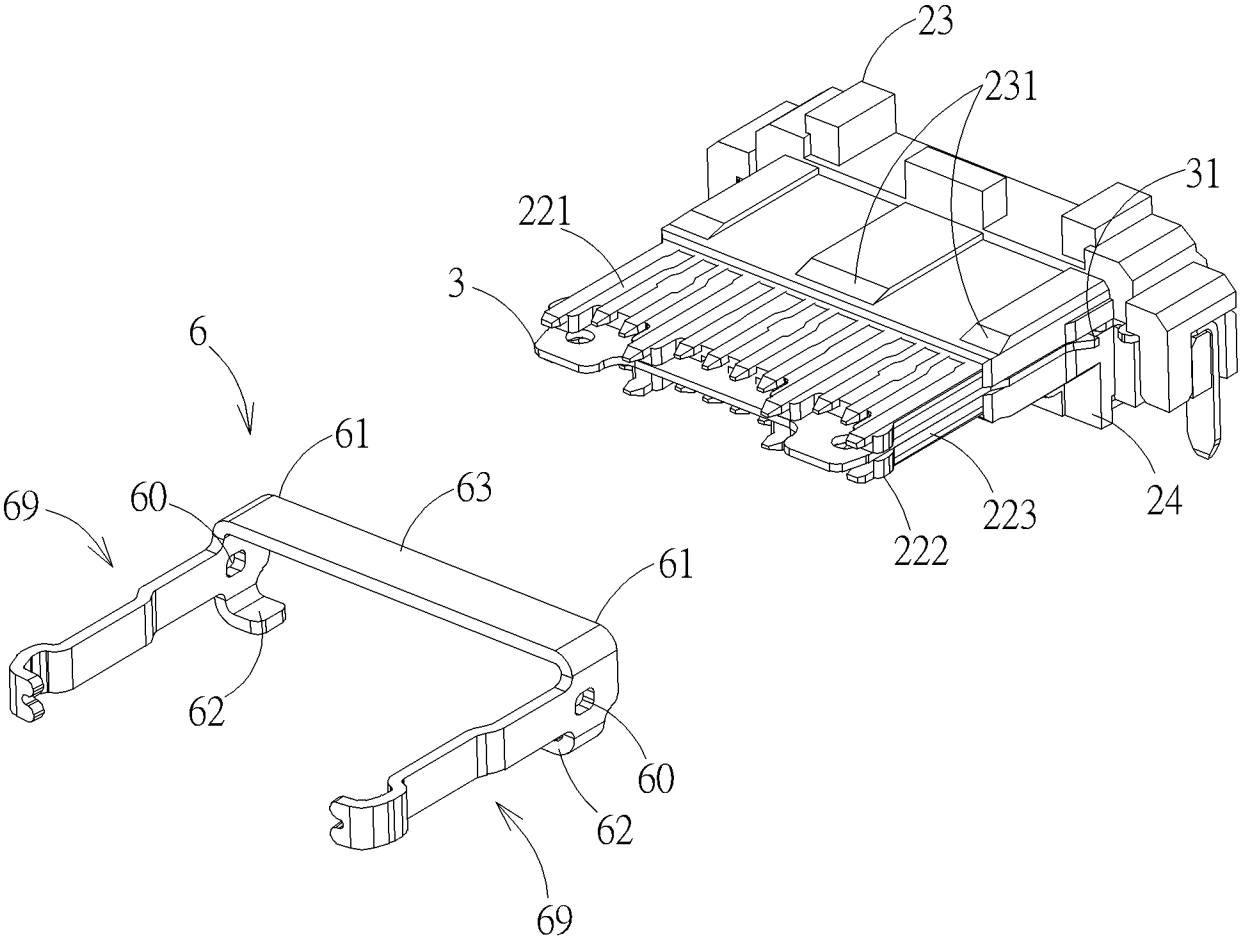
FIG. 6 is a schematic diagram of the protecting component and an assembly of an insulating main body and the shielding plate according to the embodiment of the present invention.
Figure 7:
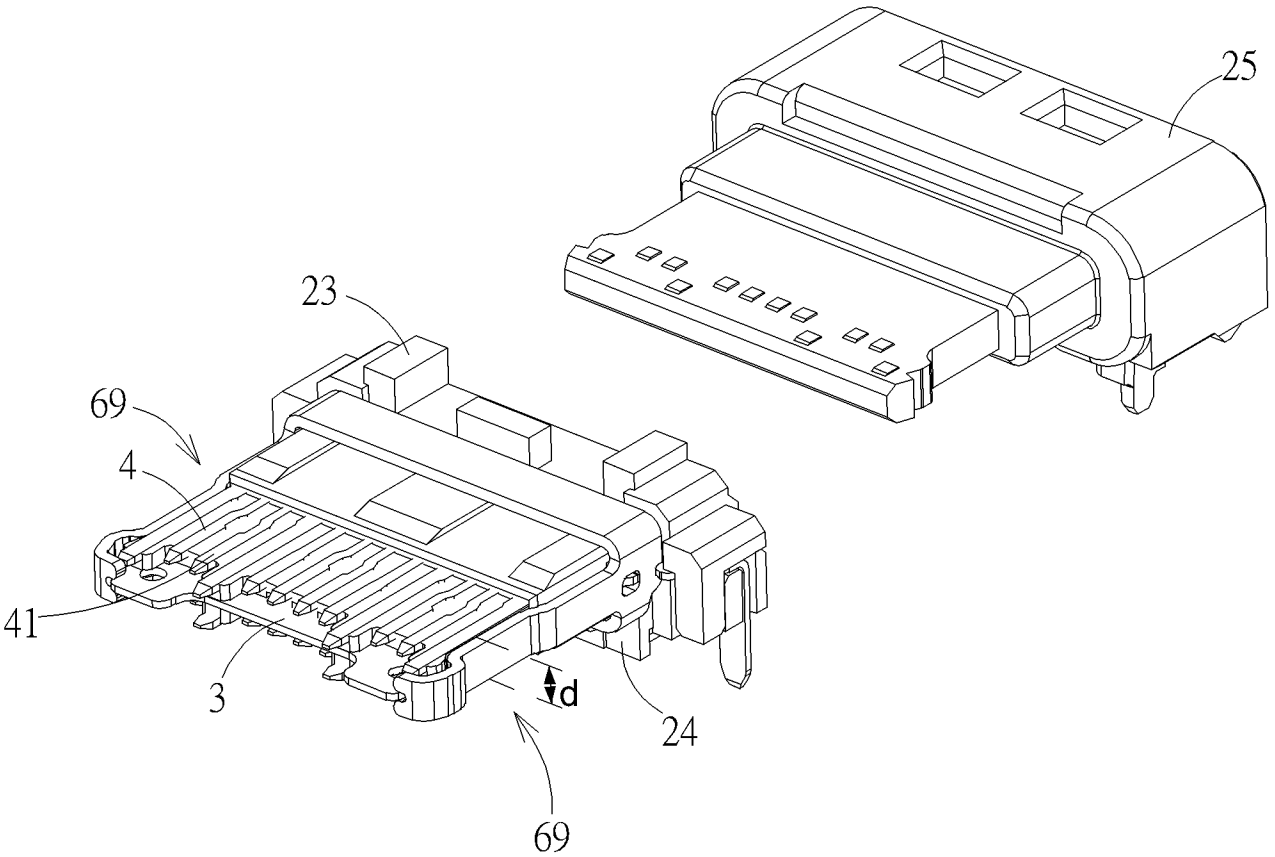
FIG. 7 is a schematic diagram of a third main portion and an assembly of a first main portion and a second main portion of the insulating main body according to the embodiment of the present invention.
Figure 8:
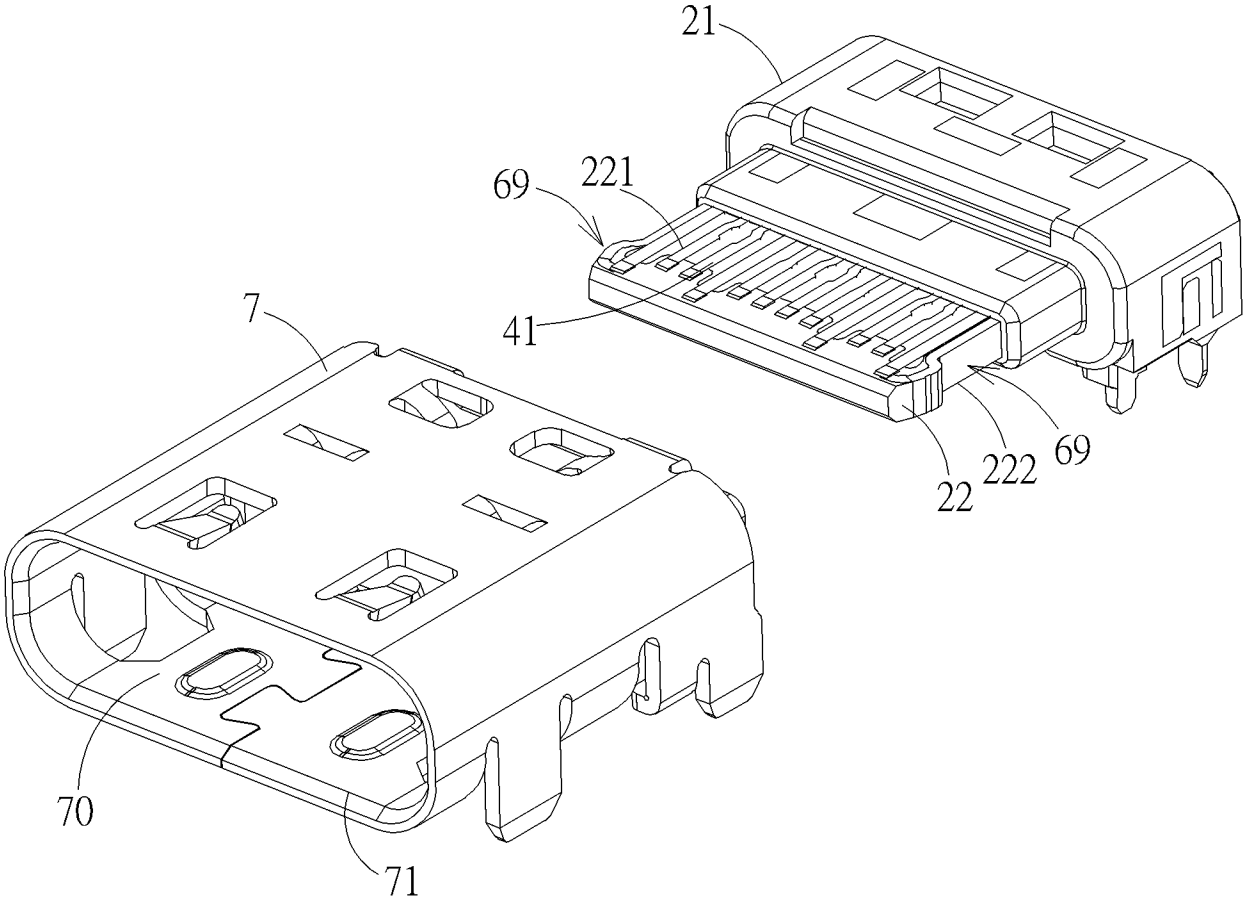
FIG. 8 is a schematic diagram of a housing and the insulating main body according to the embodiment of the present invention.

Please refer to FIG. 1 to FIG. 8. FIG. 1 is a schematic diagram of a connector structure 1 according to an embodiment of the present invention. FIG. 2 is an exploded diagram of the connector structure 1 as shown in FIG. 1 according to the embodiment of the present invention. FIG. 3 is a schematic diagram of a shielding plate 3 of the connector structure 1 as shown in FIG. 2 according to the embodiment of the present invention. FIG. 4 is a schematic diagram of a protecting component 6 of the connector structure 1 as shown in FIG. 2 according to the embodiment of the present invention. FIG. 5 is a schematic diagram of the protecting component 6 assembled with the shielding plate 3 according to the embodiment of the present invention. FIG. 6 is a schematic diagram of the protecting component 6 and an assembly of an insulating main body 2 and the shielding plate 3 according to the embodiment of the present invention. FIG. 7 is a schematic diagram of a third main portion 25 and an assembly of a first main portion 23 and a second main portion 24 of the insulating main body 2 according to the embodiment of the present invention. FIG. 8 is a schematic diagram of a housing 7 and the insulating main body 2 according to the embodiment of the present invention. The connector structure 1 includes the insulating main body 2, the shielding plate 3, a plurality of first terminals 4, a plurality of second terminals 5, the protecting component 6 and the housing 7. The connector structure 1 can be welded on a circuit board (not shown in figures).

The insulating main body 2 includes a base portion 21 and a tongue portion 22 forwardly extending out of the base portion 21. The tongue portion 22 a first surface 221, a second surface 222 opposite to the first surface 221, and two lateral surfaces 223 disposed between the first surface 221 and the second surface 222 at top and bottom sides of the tongue portion 22. In this embodiment, the connector structure 1 can be traversely welded on the circuit board, but it is not limited to this. In another embodiment, the connector structure 1 can be vertically welded on the circuit board, the tongue portion 22 extends upwardly from the base portion 21, and the first surface 221 and the second surface 222 of the tongue portion 22 are disposed at left and right sides oppositely in this case.

In this embodiment, the insulating main body 2 includes a first main portion 23, a second main portion 24 and a third main portion 25 for fastening the first main portion 23 and the second main portion 24. The plurality of the first terminals 4 can be disposed on the first main portion 23 by insert molding, and the plurality of the second terminals 5 can be disposed on the second main portion 24 by insert molding. The first main portion 23 and the second main portion 24 clamp the shielding plate 3 to forma connecting terminal structure. Then, the third main portion 25 can be combined with the connecting terminal structure by insert molding, so as to cover the shielding plate 3, the first main portion 23 and the second main portion 24.

Understandably, in this embodiment, the first main portion 23, the second main portion 24 and the third main portion 25 are respectively parts of the base portion 21 and the tongue portion 22 of the insulating main body 2. The first surface 221 is formed on the first main portion 23, the second surface 222 is formed on the second main portion 24, and the third main portion 25 forms a front end of the tongue portion and covers the first main portion 23 and the second main portion 24. The first main portion 23 and the second main portion 24 clamp the shielding plate 3, so that the two lateral surfaces 223 disposed between the first surface 221 and the second surface 222 are formed as discontinuous surfaces, but it is not limited to this. In another embodiment, the two lateral surfaces 223 can be formed as continuous surfaces connected between the first surface 221 and the second surface 222 by insert molding.

The shielding plate 3 is installed inside the tongue portion 22 and disposed between the first surface 221 and the second surface 222. In this embodiment, the shielding plate 3 includes two interfering portions 31 at two rear sides and two stopping portions 32 located in positions corresponding to the two interfering portions 31. The interfering portion 31 and the corresponding stopping portion 32 can be aligned on the same line. Besides, the shielding plate 3 further includes two rail portions 33 at two front sides and two pins 34 at two rear sides. The shielding plate 3 further includes a plurality of through holes 35 for facilitating assembly of the shielding plate 3 between the first main portion 23 and the second main portion 24, but it is not limited to this. In another embodiment, the plurality of through holes 35 can facilitate combining the shielding plate 3 with the first main portion 23 or the second main portion 24 by insert molding, which enhances a fastening effect and simplicity and convenience of manufacture.

The plurality of first terminal 4 are disposed on the first surface 221 of the tongue portion 22. Each first terminal 4 includes a first contacting portion 41 at a front end and a first pin portion at a rear end (not shown in figures). The first contacting portion 41 is disposed on the first surface 221 of the tongue portion 22, and the first pin portion protrudes out of the base portion 21. Similarly, the plurality of second terminal 5 are disposed on the second surface 222 of the tongue portion 22. Each second terminal 5 includes a second contacting portion 51 at a front end and a second pin portion at a rear end (not shown in figures). The second contacting portion 51 is disposed on the second surface 222 of the tongue portion 22, and the second pin portion protrudes out of the base portion 21.

The protecting component 6 includes two protecting portions 69 disposed on the two lateral surfaces 223 of the tongue portion 22 for protecting the two lateral surfaces 223 of the tongue portion 22 from be worn as the connector structure 1 is docked with a docking connector (not shown in figures). The protecting component 6 includes two engaging portions 60 at rear ends of the two protecting portions 69 for engaging with the two interfering portions 31 so as to fasten the protecting component 6 on the shielding plate 3. In this embodiment, the protecting component 6 can at least partially, preferably entirely, covers the two lateral surfaces 223, that is discontinuous surfaces, so as to provide a better protecting effect. The interfering portion 31 can be a protrusion, the engaging portion 60 can be a hole, and the protrusion can insert into the hole. Besides, the protecting component 6 further includes two first guiding portions 61 and two second guiding portions 62 opposite to each other and located in positions near the two engaging portions 60 at the rear ends of the two protecting portions 69. Each first guiding portion 61 corresponds to the first surface 221, each second guiding portion 62 corresponds to the second surface 222, and the first surface 221 and the second surface 222 are disposed between the first guiding portions 61 and the second guiding portions 62. A distance D between the first guiding portion 61 and the second guiding portion 62 can be greater than a distance d between the first surface 221 and the second surface 222, so as to facilitate installation of the protecting component 6. The first guiding portion 61 corresponding to the first surface 221, the second guiding portion 62 corresponding to the second surface 222, and the corresponding protecting portion 69 corresponding to the lateral surface 223 can be substantially formed in a U-shaped structure, and the U-shaped structure sheathes the first main portion 23 and the second main portion 24 of the insulating main body 2, so as to ensure the stability of the protecting component 6 and prevent sway of the protecting component 6.

It should be noticed that the protecting component 6 can further include a connecting portion 63 connected with the two protecting portions 69, so that the protecting component 6 can be substantially formed in a U-shaped structure integrally. The connecting portion 63 and the two protecting portions 69 can be integrated by metal stamping, but it is not limited to this. In another embodiment, the connecting portion 63 can be omitted, and the two protecting portions 69 are separate structures. The protecting component 6 further includes two slot portions 64 at front ends of the two protecting portions 69, and the shielding plate 3 includes the two rail portions 33. The slot portions 64 can engage with the corresponding rail portions 33, so as to fix the protecting component 6 on the shielding plate 3 and prevent the protecting component 6 from swaying. Besides, the protecting component 6 includes two blocking portions 65 at the rear ends of the two protecting portions 69, and the shielding plate 3 includes the two stopping portions 32 for stopping the two blocking portions 65 from moving backwardly as assembling the protecting component 6 with the shielding plate 3 from front to back.

In this embodiment, each protecting portion 69 of the protecting component 6 includes a rear portion 66, a middle portion 67 and a front portion 68. A front end and a rear end of the middle portion 67 are respectively connected to the front portion 68 and the rear portion 66, the middle portion 67 covers the lateral surface 223 of the tongue portion 22, and the rear portion 66 can be fixed inside the third main portion 25 of the insulating main body 2 by insert molding. The middle portion 67 exposes out of the third main portion 25. The front portion 68 includes a front bending part 681, a reinforced part 682 and a rear bending part 683. A front end and a rear end of the reinforced part 682 are respectively connected to the front bending part 681 and the rear bending part 683, and the front bending part 681, the reinforced part 682 and the rear bending part 683 can be formed in a hook-shaped structure bent outwardly. That is, the two front portions 68 have two sunken cavities facing to each other. The reinforced part 682 protrudes relative to the shielding plate 3/the tongue portion 22 than the front bending part 681 and the rear bending part 683. The front bending part 681 can be fixed inside the third main portion 25 by insert molding. The reinforced part 682 and the rear bending part 683 expose out of the third main portion 25.

It should be noticed that, in this embodiment, the reinforced part 682 of the front portion 68 protrudes relative to the tongue portion 22 than the middle portion 67. Therefore, the reinforced part 682 bears more plugging force as docking with the docking connector, so as to be worn easily. Hence, the protecting component 6 can be made of material with high hardness, such as Type 301 stainless steel. The protecting component 6 can be harder than the shielding plate 3, which has advantages of high wear resistance and reducing manufacture cost. Besides, the first main portion 23 includes a first inclined part 231 corresponding to the first guiding portion 61, and the second main portion 24 includes a second inclined part (not shown in figures) corresponding to the second guiding portion 62. The second inclined part has a similar structure to a structure of the first inclined part 231 and is not illustrated in figures. The first inclined part 231 and the second inclined part facilitate assembly of the protecting component 6 sheathed between the first main portion 23 and the second main portion 24 of the insulating main body 2. Furthermore, a distance P1 between the two middle portions 67 can be less than a distance P2 between the two rear portions 66, so as to facilitate the assembly of the protecting component 6. For protecting the two lateral surfaces 223 of the tongue portion 22 effectively under the condition of not interfering with the first surface 221 and the second surface 222 of the tongue portion 22 and taking the consideration of formability and manufacture cost, heights H of the rear portion 66, the middle portion 67 and the front portion 68 of the protecting component 6 can be substantially from 0.4 mm to 0.65 mm, and thicknesses T of the rear portion 66, the middle portion 67 and the front portion 68 of the protecting component 6 can be substantially from 0.15 mm to 0.2 mm, so as to achieve purposes of protection and economic production. Besides, the housing 7 surrounds the tongue portion 22 to define a docking space 70, and an opening 71 is formed on a side of the docking space 70 for accommodating the docking connector.

Figure 9:
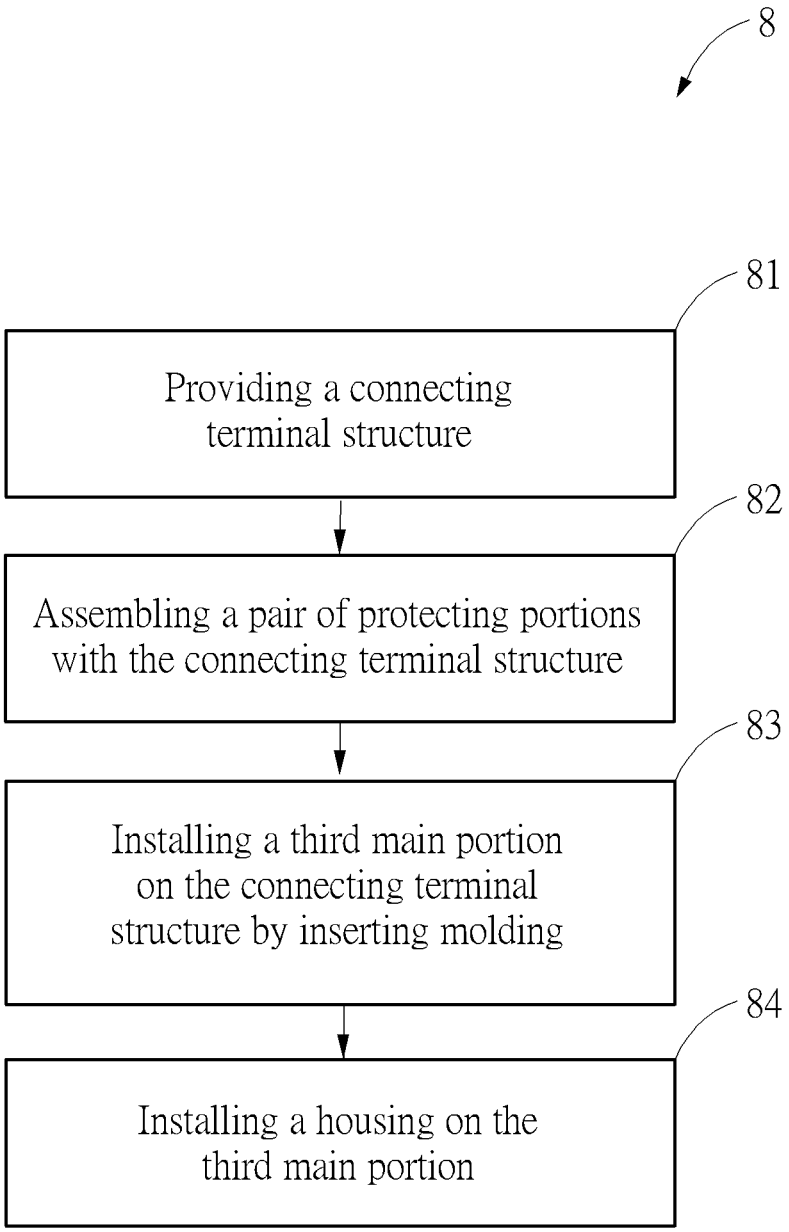
FIG. 9 is a flowchart illustrating a method of manufacturing the connector structure as shown in FIG. 1 according to the embodiment of the present invention.

Please refer to FIG. 6 to FIG. 8 and FIG. 9. FIG. 9 is a flowchart illustrating a method 8 of manufacturing the connector structure 1 as shown in FIG. 1 according to the embodiment of the present invention. The method 8 includes a step 81 of providing the connecting terminal structure, wherein the connecting terminal structure includes the first main portion 23, the second main portion 24 opposite to the first main portion 23, and the shielding plate 3 disposed between the first main portion 23 and the second main portion 24, the plurality of the first terminals 4 are disposed on the first main portion 23, the plurality of the second terminals 5 are disposed on the second main portion 24, and the shielding plate 3 includes the two interfering portions 31 at two lateral sides on the rear end of the shielding plate 3. Then, as shown in FIG. 6, the method further includes a step 82 of assembling the pair of protecting portions 69 with the connecting terminal structure, wherein the pair of protecting portions 69 are inserted into the first main portion 23 and the second main portion 24 along two sides of the shielding plate 3 from front to back, and each protecting portion 69 includes the engaging portion 60 on the rear end of the protecting portion 69 for engaging with the corresponding interfering portion 31. Then, as shown in FIG. 7, the method further includes a step 83 of installing the third main portion 25 on the connecting terminal structure by inserting molding, wherein the third main portion 25 covers the engaging portion 60, the two interfering portions 31, the first main portion 23 and the second main portion 24, so as to combine the engaging portion 60, the two interfering portions 31, the first main portion 23 and the second main portion 24. At last, as shown in FIG. 8, the method further includes a step 84 of installing the housing 7 on the third main portion 25, so as to accomplish the assembly of the connector structure 1.

It should be noticed that, in this embodiment, the first main portion 23 and the second main portion 24 of the connecting terminal structure have shapes with narrow/small front and wide/large rear, so that the preferably assembling way for the pair of protecting portions 69 formed in U-shaped structures is to insert into the first main portion 23 and the second main portion 24 from front to back. Understandably, for fitting an outline of the connecting terminal structure, the pair of protecting portions 69 can also have shapes with narrow/small front and wide/large rear, as shown in FIG. 4. Besides, as for the step 81 of providing the connecting terminal structure, it can have at least two kinds of sub-steps. One sub-step is to provide the first main portion 23 and the second main portion 24 first, dispose the plurality of the first terminals 4 and the plurality of the second terminals 5 on the first main portion 23 and the second main portion 24 by inert molding respectively, and then dispose the shielding plate 3 between the first main portion 23 and the second main portion 24, wherein the shielding plate 3 includes at least one interfering portion 31 at rear sides. The other sub-step is to provide the first main portion 23 first, dispose the plurality of the first terminals 4 and the shielding plate 3 on the first main portion 23 by insert molding, dispose the second main portion 24 on the shielding plate 3, so as to position the shielding plate 3 between the first main portion 23 and the second main portion 24, wherein the shielding plate 3 includes at least one interfering portion 31 at rear sides, and then dispose the plurality of the second terminals 5 on the second main portion 24 by insert molding.

In contrast to the prior art, the connector structure of the present invention utilizes the protecting portions disposed on the two lateral sides of the tongue portion for protecting the lateral sides of the tongue portion so as to reinforce structure of the tongue portion. The structural design of the present invention can solve a conventional problem that a tongue of a conventional connector might be worn or deformed as being connected with a docking connector, resulting in unstable structure and affecting high frequency signal transmission.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector structure comprising:

an insulating main body comprising a base portion and a tongue portion extending out of the base portion, the tongue portion comprising a first surface, a second surface opposite to the first surface, and two lateral surfaces disposed between the first surface and the second surface;

a shielding plate disposed inside the tongue portion and between the first surface and the second surface, the shielding plate comprising at least one interfering portion;

a plurality of first terminals disposed on the first surface of the tongue portion;

a plurality of second terminals disposed on the second surface of the tongue portion;

a protecting component at least partially disposed on the two lateral surfaces of the tongue portion, the protecting component comprising at least one engaging portion for engaging with the at least one interfering portion; and a housing surrounding the tongue portion to define a docking space, an opening being formed on a side of the docking space.

2. The connector structure of claim 1, wherein the protecting component comprises at least one slot portion, and the shielding plate comprises at least one rail portion for engaging inside the at least one slot portion.

3. The connector structure of claim 1, wherein the protecting component comprises at least one first guiding portion and at least one second guiding portion opposite to each other, the at least one first guiding portion corresponds to the first surface, the at least one second guiding portion corresponds to the second surface, the first surface and the second surface are disposed between the at least one first guiding portion and the at least one second guiding portion, and a distance between the at least one first guiding portion and the at least one second guiding portion is greater than a distance between the first surface and the second surface.

4. The connector structure of claim 3, wherein the insulating main body comprises a first main portion, a second main portion and a third main portion for fastening the first main portion and the second main portion, the plurality of the first terminals are disposed on the first main portion, the plurality of the second terminals are disposed on the second main portion, the first main portion comprises a first inclined part corresponding to the at least one first guiding portion, and the second main portion comprises a second inclined part corresponding to the at least one second guiding portion.

5. The connector structure of claim 1, wherein the protecting component comprises at least one blocking portion, and the shielding plate comprises at least one stopping portion for stopping the at least one blocking portion from moving backwardly.

6. The connector structure of claim 1, wherein the protecting component comprises at least one rear portion, at least one middle portion and at least one front portion, a front end and a rear end of the at least one middle portion are respectively connected to the at least one front portion and the at least one rear portion, the at least one middle portion covers the lateral surface of the tongue portion, and the at least one rear portion is fixed inside the insulating main body by insert molding.

7. The connector structure of claim 6, wherein the at least one front portion comprises a front bending part, a reinforced part and a rear bending part, a front end and a rear end of the reinforced part are respectively connected to the front bending part and the rear bending part, and the front bending part, the reinforced part and the rear bending part are formed in a hook-shaped structure bent outwardly, the front bending part is fixed inside the insulating main body by insert molding, and the reinforced part protrudes relative to the tongue portion than the front bending part and the rear bending part.

8. The connector structure of claim 7, wherein the reinforced part of the at least one front portion protrudes relative to the tongue portion than the at least one middle portion.

9. The connector structure of claim 6, wherein the protecting component comprises two rear portions, two middle portions and two front portions, and a distance between the two middle portions is less than a distance between the two rear portions.

10. The connector structure of claim 1, wherein each lateral surface is a discontinuous surface, and the protecting component covers the discontinuous surface.

11. The connector structure of claim 1, wherein the protecting component is harder than the shielding plate.

12. The connector structure of claim 1, wherein a height of the protecting component is substantially from 0.4 mm to 0.65 mm.

13. The connector structure of claim 6, wherein a height of the at least one middle portion of the protecting component is substantially from 0.4 mm to 0.65 mm.

14. The connector structure of claim 1, wherein a thickness of the protecting component is substantially from 0.15 mm to 0.2 mm.

15. The connector structure of claim 6, wherein thicknesses of the at least one middle portion, the at least one rear portion and the at least one front portion of the protecting component are substantially from 0.15 mm to 0.2 mm.

16. The connector structure of claim 6, wherein the protecting component comprises two rear portions, two middle portions and two front portions, and the protecting component further comprises a connecting portion connected with the two rear portions so as to form the protecting component integrally.

17. A method of manufacturing a connector structure, comprising:

providing a connecting terminal structure, the connecting terminal structure comprising a first main portion, a second main portion opposite to the first main portion, and a shielding plate disposed between the first main portion and the second main portion, a plurality of the first terminals being disposed on the first main portion, a plurality of the second terminals being disposed on the second main portion, the shielding plate comprising two interfering portions at two lateral sides on an rear end of the shielding plate;

assembling a pair of protecting portions with the connecting terminal structure, the pair of protecting portions inserting into the first main portion and the second main portion along two sides of the shielding plate from front to back, each protecting portion comprising an engaging portion on an rear end of the protecting portion for engaging with the corresponding interfering portion; and installing a third main portion on the connecting terminal structure by inserting molding, the third main portion covering the engaging portion, the two interfering portions, the first main portion and the second main portion.

18. The method of claim 17, further comprising:

installing a housing on the third main portion.

19. The method of claim 17, wherein each protecting portion comprises a slot portion on a front end of the protecting portion, and the shielding plate comprises two rail portions at two lateral sides on a front end of the shielding plate for engaging inside the slot portion.

20. The method of claim 17, wherein a first guiding portion and a second guiding portion extend from each protecting portion and opposite to each other, the first guiding portion, the second guiding portion and the corresponding protecting portion are formed in a U-shaped structure, and the U-shaped structure sheathes the first main portion and the second main portion.

21. The method of claim 20, wherein the first main portion comprises a first inclined part corresponding to the first guiding portion, and the second main portion comprises a second inclined part corresponding to the second guiding portion.

22. The method of claim 17, wherein each protecting portion comprises a blocking portion, and the shielding plate comprises at least one stopping portion for stopping the blocking portion from moving backwardly.

23. The method of claim 17, wherein each protecting portion comprises a rear portion, a middle portion and a front portion, a front end and a rear end of the middle portion are respectively connected to the front portion and the rear portion, the middle portion exposes out of the third main portion, and the rear portion is fixed inside the third main portion by insert molding.

24. The method of claim 23, wherein the front portion comprises a front bending part, a reinforced part and a rear bending part, a front end and a rear end of the reinforced part are respectively connected to the front bending part and the rear bending part, and the front bending part, the reinforced part and the rear bending part are formed in a hook-shaped structure bent outwardly, the front bending part is fixed inside the third main portion by insert molding, and the reinforced part protrudes relative to the shielding plate than the front bending part and the rear bending part.

25. The method of claim 17, wherein a distance between the two middle portions of the pair of protecting portions is less than a distance between the two rear portions of the pair of protecting portions.

26. The method of claim 17, wherein each protecting portion is harder than the shielding plate.

27. The method of claim 17, wherein a height of each protecting portion is substantially from 0.4 mm to 0.65 mm.

28. The method of claim 17, wherein a thickness of each protecting portion is substantially from 0.15 mm to 0.2 mm.

29. The method of claim 17, wherein a connecting portion is connected between the pair of protecting portions.

* * * * *